United States Patent [19]

Porosoff

[11] 4,219,523

[45] * Aug. 26, 1980

[54] MELT-SPINNING ACRYLONITRILE POLYMER FIBER FROM LOW MOLECULAR WEIGHT POLYMERS

[75] Inventor: Harold Porosoff, Scarsdale, N.Y.

[73] Assignee: American Cyanamid Co., Stamford, Conn.

[ * ] Notice: The portion of the term of this patent subsequent to Aug. 7, 1996, has been disclaimed.

[21] Appl. No.: 938,201

[22] Filed: Aug. 30, 1978

Related U.S. Application Data

[60] Continuation-in-part of Ser. No. 803,005, Jun. 3, 1977, abandoned, which is a continuation-in-part of Ser. No. 698,566, Jun. 22, 1976, abandoned, which is a continuation-in-part of Ser. No. 349,877, Apr. 10, 1973, abandoned, which is a division of Ser. No. 344,463, Mar. 23, 1973, abandoned, which is a continuation-in-part of Ser. No. 337,506, Mar. 2, 1973, abandoned, which is a continuation-in-part of Ser. No. 329,479, Feb. 5, 1973, abandoned.

[51] Int. Cl.[2] ..... D01F 6/18

[52] U.S. Cl. ..... 264/206; 264/210.3; 264/210.6; 264/210.8; 264/211; 264/342 RE

[58] Field of Search ..... 264/206, 210.3, 210.6, 264/210.8, 211, 342 RE

[56] References Cited

U.S. PATENT DOCUMENTS

| | | | |
|---|---|---|---|
| 2,585,444 | 2/1952 | Coxe | 264/182 |
| 3,873,508 | 3/1975 | Turner | 264/206 |
| 3,896,204 | 7/1975 | Goodman et al. | 264/206 |
| 3,984,601 | 10/1976 | Blickenstaff | 264/206 |
| 3,991,153 | 11/1976 | Klausner et al. | 264/206 |
| 4,163,770 | 8/1979 | Porosoff | 264/342 RE |

*Primary Examiner*—Jay H. Woo

*Attorney, Agent, or Firm*—William J. van Loo

[57] ABSTRACT

Acrylonitrile polymers having number average molecular weights in the range of about 6,000 up to about 15,750 provide fiber of desirable properties when melt-spun as a fusion melt with water.

3 Claims, No Drawings

MELT-SPINNING ACRYLONITRILE POLYMER FIBER FROM LOW MOLECULAR WEIGHT POLYMERS

CROSS-REFERENCE TO RELATED APPLICATIONS

This application is a continuation-in-part of application Ser. No. 803,005, filed June 3, 1977, now abandoned which application is a continuation-in-part of Application Ser. No. 698,566 (now abandoned), filed June 22, 1976, which application is, in turn, is a continuation-in-part of Application Ser. No. 349,877, filed Apr. 10, 1973, now abandoned which application is, in turn, a division of Application Ser. No. 344,463 (now abandoned), filed Mar. 23, 1973, which application is, in turn, a continuation-in-part of Application Ser. No. 337,506, filed Mar. 2, 1973 (now abandoned), which application is, in turn, a continuation-in-part of Application Ser. No. 329,479, filed Feb. 5, 1973 (now abandoned).

This application relates to a process for preparing acrylonitrile polymer fiber. More particularly, this invention relates to such a process wherein a low molecular weight acrylonitrile polymer is effectively spun into fiber of desirable physical properties for a variety of uses.

In the recent publication *Formation of Synthetic Fibers*, Z. K. Walczak, Gordon and Breach, New York, New York, (1977), on page 271, there is provided a table in which the effective values of molecular weight for spinning fiber from various polymers are given. This table is reprinted from Die Physik der Hochpolymereu, Prof. H. Mark, edited by H. A. Stuart, Springer Verlag Berlin, Germany (1956) Vol. 4, pages 629. In this table, it specifies that the lower limiting number average molecular weight value for fiber-forming acrylonitrile polymers is 15,000 and that below this value no fiber of any value is obtained. To ensure that adequate physical properties are obtained, commercial procedures employ polymers of at least 16,000, and generally greater than about 18,000. The upper limiting number average molecular weight value is said to be 45,000 and that above this value no advantages in fiber properties are obtained but larger demands are put on mechanical work to overcome high viscosity without any gains in terms of fiber properties.

Even within the molecular weight ranges specified for acrylonitrile polymers, considerable difficulties arise because of rheological properties of those polymers. Recent developments in the preparation of acrylonitrile polymer fibers have led to a melt-spinning process wherein a fusion melt of an acrylonitrile polymer and water at a temperature above the boiling point of water at atmospheric pressure but at a superatmospheric pressure sufficient to maintain water in liquid state is spun through a spinnerette to form fiber. A preferred procedure for conducting this process is to spin the fusion melt directly into a steam-pressurized solidification zone which controls the rate of release of water from the nascent extrudate to prevent deformation thereof as it leaves the spinnerette and enables a high degree of filament stretching to be obtained. Fusion melts of the acrylonitrile polymers having the number average molecular weight values specified in the above-cited art have melt-flow characteristics that cause difficulties in spinning fusion melts thereof. Their melt-flow characteristics make them difficult to extrude except through large orifices. Extrudates obtained from large orifices require extensive stretching to provide fiber of textile denier and the high molecular weight values make the necessary stretching extremely difficult to achieve.

What is needed, therefore, is a melt-spinning process for acrylonitrile polymers which overcomes the problems associated with the prior processes while still providing fiber of desired physical properties. Such a provision would satisfy a long-felt need and constitute a significant advance in the art.

In accordance with the present invention, there is provided a process for preparing an acrylonitrile polymer fiber of desirable physical properties which comprises providing a homogeneous fusion melt of an acrylonitrile copolymer and water at a temperature above the boiling point of water at atmospheric pressure and at a temperature and pressure sufficient to maintain water and said polymer as a homogeneous fusion melt, said polymer having a number average molecular weight in the range of about 6,000 up to about 15,750, extruding said fusion melt through a spinnerette directly into a steam-pressurized solidification zone maintained under conditions which control the rate of release of water from the nascent extrudate as it emerges from the spinnerette to avoid deformation of said extrudate and stretching said extrudate while in said solidification zone at a stretch ratio sufficient to provide desirable physical properties thereto.

In preferred embodiments, the extrudate is stretched while in the solidification zone at a stretch ratio of at least 10, preferably at least 25. In a still more preferable embodiment, the stretching is done in two stages with the stretch ratio in the first stage being less than that in the second stage. A preferred processing step is that of drying the stretched extrudate under conditions of temperature and humidity to remove water therefrom while avoiding formation of a separate water phase therein. After such drying, it is generally preferred to conduct steam-relaxation on the dried extrudate under conditions which provide shrinkage thereof to the extent of about 15–40%.

In another aspect of the present invention, there is provided an acrylonitrile polymer fiber consisting essentially of an acrylonitrile copolymer having a number average molecular weight of about 6,000 to about 15,750, said fiber having a desirable physical properties.

In preferred embodiments, the fiber provided will have a straight tenacity of at least about 2.0 grams per denier, a straight elongation of at least about 20%, and a loop tenacity of at least about 1.8 grams per denier.

The process of the present invention unexpectedly provides acrylonitrile polymer fiber of useful physical properties for many applications in spite of the fact that it employs polymers of number average molecular weight values that are reported to be too low to provide fiber of any value.

The fiber of the present invention has desirable physical properties that render it useful in many industrial applications as well as for textile purposes depending upon processing steps conducted thereon. In preferred embodiments, the fiber of the present invention has physical properties that are equivalent to many of the current acrylonitrile polymer fibers commercially offered and, therefore are useful in those same applications that the commercial acrylonitrile polymer fibers are employed. Thus, the fiber of the present invention is useful in textile, carpet, paper and other industrial applications.

In order to prepare the fiber of the present invention, it is necessary to employ the process described using a typical acrylonitrile polymer composition that has a lower number average molecular weight than those acrylonitrile polymers heretofore used for fiber-forming. Thus, the composition of the fiber-forming acrylonitrile polymer used in the present invention will be the same as any of those previously known fiber-forming acrylonitrile polymers but the acrylonitrile polymer used in the present invention will differ therefrom in number average molecular weight. As indicated, the acrylonitrile polymer used in the present invention will have a number average molecular weight in the range of about 6,000 up to about 15,750, preferably about 7,500 to about 14,500. Thus, in preparing acrylonitrile polymers for use in the present invention, polymerization should be conducted so as to provide the proper number average molecular weight in accordance with conventional procedures.

The number average molecular weight values ($M_n$) reported in the present application were determined by gel permeation chromatography using a Waters Gel Permeation Chromatograph, cross-linked polystyrene gel column packing and dimethyl formamide—0.1 molar lithium bromide solvent. The chromatograph was calibrated using a set of four acrylonitrile polymers for which $\overline{M}_n$ and weight average molecular weight ($\overline{M}_w$) had been determined by membrane osmometry and light scattering measurements, respectively. The GPC calibration constants were determined by adjusting them to get the best fit between $\overline{M}_n$ and $\overline{M}_w$ values and values calculated from the chromatograms of polydisperse samples.

Useful polymers for preparing fiber in accordance with the present invention are copolymers of acrylonitrile and one or more monomers copolymerizable therewith. Such polymers will contain at least about 1 mol percent of comonomer, preferably at least about 3 mol percent thereof. The copolymer will contain at least about 50 mol percent of acrylonitrile, preferably at least about 70 mol percent thereof.

Once a suitable acrylonitrile polymer has been selected, it is necessary to provide a homogeneous fusion melt of the polymer and water at a temperature above the boiling point of water at atmospheric pressure and at a superatmospheric pressure sufficient to maintain water and polymer as a homogeneous fusion melt. The particular temperatures and pressures useful will vary widely depending upon polymer composition but can readily be determined following prior art teachings, which also teach the proper proportions of polymer and water necessary to provide a homogeneous fusion melt.

After the homogeneous fusion melt is provided, it is spun through a spinnerette directly into a steam-pressurized solidification zone. The steam-pressurized solidification zone is maintained under conditions such that the rate of release of water from the nascent extrudate is controlled so as to prevent deformation of the extrudate as it emerges from the spinnerette.

Without a steam-pressurized solidification zone, water would rapidly vaporize from the nascent extrudate causing foaming, structure inflation, and structure deformation to such an extent that fiber of poor properties is obtained. The steam pressure will be low enough to allow the extrudate to solidify but high enough to maintain the extrudate in a plastic state so that it can be subjected to stretching while in the solidification zone. Stretching in the solidification zone should be conducted at a stretch ratio which is sufficient to provide useful physical properties in the resulting fiber. In preferred instances, it is preferred to stretch the extrudate at a stretch ratio of at least about 10, more preferably at least 25. In the preferred instances, it is desirable to conduct stretching in two stages, a first stage being conducted at a stretch ratio below that effected in the second stage. Generally the total stretch ratio effected in both stages should be 15 or more, preferably 25 or more.

After the extrudate exits from the solidification zone, it may be further processed in accordance with conventional procedures. For textile purposes, it is generally preferable to dry the extrudate under conditions of temperature and humidity that remove water therefrom without forming a separate phase of water therein. Such drying provides fiber of improved transparency and improved dye intensity. It is also preferred to relax the dried fiber in steam to provide a desirable balance of physical properties. Usually relaxation is conducted so as to effect about 15 to 40% shrinkage.

The acrylonitrile polymer fiber provided by the present invention is typical of acrylonitrile polymer fibers in general and differs therefrom essentially only in the number average molecular weight of the fiber-forming polymer, the present invention employing a lower number average molecular weight value. Although homopolymers of acrylonitrile are contemplated in the prior art as fiber-forming polymers, the present invention requires at least about 1 mol percent of comonomer in the polymer composition to provide processability.

Physical properties of commercial acrylic fibers as given in *Textile World Manmade Fiber Chart*, 1977 McGraw-Hill, New York, N.Y. are as follows:

Straight tenacity 2.0–3.6 grams per denier
Straight Elongation 20–50%
Loop Tenacity 1.8–2.3 grams per denier.

These values are all associated with acrylic fiber that has been obtained by wet-spinning or dry-spinning because no commercial method for melt-spinning acrylic fiber is yet in production. Typical of the acrylic fibers commercially available and representative values of the number average molecular weight of the fiber-forming polymer employed to provide the fiber are given in the following listing:

| Acrylic Fiber | Number Average MW |
|---|---|
| Acrilan 94 | 22,000 |
| Acrilan 90 | 19,500 |
| Acrilan S-16 | 22,000 |
| Orlon 30 | 20,000 |
| Orlon 75 | 18,300 |
| Dralon | 16,000 |
| Creslan T-61 | 20,000 |
| Zefran T-201 | 23,700 |
| Courtelle | 32,200 |

The present invention, in spite of its use of low molecular weight fiber-forming polymers, provides acrylonitrile polymer fiber that has physical property values well within the range of typical acrylic fiber properties and in many cases exceeds these values.

The invention is more fully illustrated by the examples which follow wherein all parts and percentages are by weight unless otherwise specified.

COMPARATIVE EXAMPLE A

An acrylonitrile polymer containing 89.3% acrylonitrile and 10.7% methyl methacrylate and having a number average molecular weight of 20,500 was employed. A composition of 82 parts of polymer and 18 parts of water was processed to provide a fusion melt at 154° C. under autogeneous pressure. The fusion melt was extruded through a spinnerette at 154° C. directly into a steam-pressurized solidification zone maintained at 38 psig. While in the solidification zone the nascent extrudate was stretched in a single stage at a stretch ratio of 112. The resulting 6.4 d/f fiber was relaxed in steam at 127° C. to provide 8.3 d/f fiber. Fiber properties were as follows:

Straight tenacity: 3.5 grams/denier
Straight elongation: 43%
Loop tenacity: 1.98 grams/denier
Loop elongation: 19%

This example shows that prior art fusion melt spinning of acrylonitrile polymers in the range of number average molecular weights of 15,000 to 45,000 provides acrylic fiber of acceptable properties when subjected to a single stage of stretching while the nascent extrudate is in the solidification zone. These properties are all within the range of values for commercial acrylic fibers spun by wet-spinning and dry-spinning procedures.

COMPARATIVE EXAMPLE B

An acrylonitrile polymer containing 89.3% acrylonitrile and 10.7% methyl methacrylate was prepared according to conventional suspension procedures to provide a polymer having a number average molecular weight of 20,500. The isolated polymer cake was dried to obtain a powder containing 18.1% water.

The polymer-water mixture was heated under autogeneous pressure in a screw extruder to provide a fusion melt at 180° C. The resulting melt was spun through a spinnerette directly into a steam-pressurized solidification zone maintained at 22 pounds per square inch gauge pressure. The nascent extrudate was subjected to two stages of stretching while in the solidification zone, a first stage at a stretch ratio of 2.3 and a second stage at a stretch ratio of 10 to provide a total stretch ratio of 23. The resulting 3.7 denier per filament tow was relaxed in steam at 124° C. to provide fiber of 5.3 denier per filament (d/f). Properties of the relaxed fiber are given in Table I which follows.

EXAMPLE 1

The procedure of Comparative Example B was repeated in every material detail except that the polymer had a number average molecular weight of 13,200, the fusion melt was processed at 195° C., the solidification zone was maintained at 18 psig, the first stage stretch was at a stretch ratio of 3.3 and the second stage stretch was at a stretch ratio of 13.8 to provide a total stretch ratio of 44, and the 2.3 d/f fiber was relaxed in steam at 124° C. to provide a 3.25 d/f fiber. Properties of the fiber are also given in Table I.

EXAMPLE 2

The procedure of Comparative Example B was again followed in every material detail with the following exceptions: The polymer contained 89.7% acrylonitrile and 10.3% methyl methacrylate and had a number average molecular weight of 12,300; the polymer contained 18.3% water and was processed at 190° C.; the solidification zone was maintained at 18 psig, the first stage stretch was at a stretch ratio of 2.6 and the second stretch stage was at a stretch ratio of 17 to provide a total stretch ratio of 46; and the resulting 3.9 d/f fiber was relaxed in steam at 124° C. to provide a 5.1 d/f fiber. Physical properties are also given in Table I.

EXAMPLE 3

The procedure of Comparative Example B was again followed in every material detail with the following exceptions: the polymer contained 88.4% acrylonitrile and 11.6% methyl methacrylate and had a number average molecular weight of 11,200; the polymer contained 18.6% water and was processed at 169° C.; the solidification zone was maintained at 12 psig, the first stage stretch was at a stretch ratio of 6.1 and the second stretch stage was at a stretch ratio of 7.2 to provide a total stretch ratio of 43.9; and the resulting 2.9 d/f fiber was relaxed in steam at 120° C. to provide a 4.1 d/f fiber. Physical properties are also given in Table I.

EXAMPLE 4

The procedure of Comparative Example B was again followed in every material detail with the following exceptions: the polymer contained 88.6% acrylonitrile and 11.4% methyl methacrylate and had a number average molecular weight of 7,900; the polymer contained 13.1% water and was processed at 180° C.; the solidification zone was maintained at 11 psig, the first stretch stage was at a stretch ratio of 4.5 and the second stretch stage was at a stretch ratio of 7.1 to provide a total stretch ratio of 31.9; and the 3.0 d/f fiber was relaxed in steam at 120° C. to provide a 4.3 d/f fiber. Physical properties are also given in Table I.

EXAMPLE 5

The procedure of Comparative Example B was again followed in every material detail with the following exceptions: the polymer contained 88.4% acrylonitrile and 11.6% methyl methacrylate and had a number average molecular weight of 11,200; the polymer contained 13.5% water and was processed at 170° C.; the solidification zone was maintained at 12 psig, the first stretch stage was at a stretch ratio of 3.8 and the second stretch stage was at a stretch ratio of 12.2 to provide a total stretch ratio of 46.4; and the 3.2 d/f fiber was relaxed in steam at 125° C. to provide a 5.0 d/f fiber. Physical properties are also given in Table I.

EXAMPLE 6

The procedure of Comparative Example B was again followed in every material detail with the following exceptions: the polymer contained 87.6% acrylonitrile, 11.9% methyl methacrylate and 0.5% 2-acrylamido-2-methylpropanesulfonic acid and had a number average molecular weight of 14,400; the polymer contained 15.5% water and was processed at 171° C.; the solidification zone was maintained at 11 psig, the first stretch stage was at a stretch ratio of 3.7 and the second stretch stage was at a stretch ratio of 10.7 to provide a total stretch ratio of 39.4; and the 2.2 d/f fiber was relaxed in steam at 125° C. to provide at 3.4 d/f fiber. Physical properties are also given in Table I.

TABLE I

Properties of Low Molecular Weight Acrylonitrile Polymer Fiber

| Fiber of Example | Number Average MW | Straight Properties Tenacity (g/d) | Straight Properties Elongation (%) | Loop Properties Tenacity (g/d) | Loop Properties Elongation (%) |
|---|---|---|---|---|---|
| B | 20,500 | 5.4 | 23 | 3.8 | 15 |
| 1 | 13,200 | 3.8 | 29 | 2.4 | 23 |
| 2 | 12,300 | 4.7 | 27 | 1.9 | 13 |
| 3 | 11,200 | 3.1 | 38 | 2.0 | 23 |
| 4 | 7,900 | 2.9 | 33 | 1.8 | 18 |
| 5 | 11,200 | 3.6 | 32 | 1.8 | 16 |
| 6 | 14,400 | 2.9 | 35 | 2.3 | 19 |

It should be noted that the fiber provided by Comparative Example B has considerably greater straight and loop tenacity values than the commercial acrylic fibers prepared by wet-spinning and dry-spinning procedures. The fiber prepared by Examples 1 and 2 also have greater straight and loop properties than the commercial acrylic fibers. The fibers prepared by Examples 3–6 all have properties within the ranges of values provided by commercial acrylic fibers in spite of the low molecular weight of the fiber-forming acrylonitrile polymers.

COMPARATIVE EXAMPLE C

The procedure of Comparative Example B was again followed in every material detail except for the acrylonitrile polymer employed. In a first run employing a polymer containing 88.9% acrylonitrile and 11.1% methyl methacrylate and having a number average molecular weight of 4,500, it was not possible to successfully spin a fusion melt of the polymer and water because an unsatisfactory fiber resulted. This indicates that an acrylonitrile polymer of this number average molecular weight value is unsuitable as a fiber-forming polymer.

In another run, the polymer contained 88.5% acrylonitrile and 11.5% methyl methacrylate and had a number average molecular weight of 5,300. Spinnability of a fusion melt with water of this polymer was marginal, and proper processing to provide fiber for determination of physical properties could not be accomplished.

From these and other runs, it became apparent that the minimum number average molecular weight of an acrylonitrile polymer for spinning as a fusion melt with water was about 6,000, preferably about 7,500.

EXAMPLE 7

The procedure of Example 6 was again followed in every material detail except that the stretched fiber was dried for 23 minutes in an oven maintained at a dry bulb temperature of 138° C. and a wet bulb temperature of 74° C. The dried fiber was then relaxed in steam to provide a shrinkage of 30%. The fiber obtained was tested in accordance with the following procedures.

DYE INTENSITY

A sample of fiber is dyed with Basic Blue 1 at 0.5 weight percent, based on the weight of fiber, to complete exhaustion. The dyed sample is then dried in air at room temperature and a reflectance measurement is made versus a control using the Color-Eye at 620 millimicrons. The control sample is a commercial wet spun acrylic fiber of the same denier dyed and handled in the same manner as the experimental fiber. The result is reported as the percent reflectance of that achieved by the control. In the case where the experimental fiber has more void structure than the control, there will be more light scattered and the dyed experimental fiber will register less than 100% reflectance at 620 millimicrons. The fiber will also appear to the eye to be lighter in color than the control.

SHADE CHANGE

A twenty gram sample of carded and scoured fiber is dyed with 0.5 weight percent of Basic Blue 1 based on the weight of fiber, at the boil until complete exhaustion occurs. One portion of the dyed fiber is dried in air at room temperature. Another portion is dried in an oven at 300° F., for 20 minutes. Reflectances of both samples are obtained using the Color-Eye at 620 millimicrons. The change in reflectance of the oven-dried sample relative to the reflectance of the air dried sample is the shade change.

The dye intensity of the fiber obtained in Example 7 was 72% and the shade change was 13.

When the fiber obtained in Example 6, which was not dried under conditions of controlled temperature and humidity prior to relaxation, was subjected to the same dye tests, the fiber exhibited a dye intensity of 40 and a shade change of 13.

I claim:

1. A process for preparing an acrylonitrile polymer fiber of desirable physical properties which comprises providing a homogeneous fusion melt of an acrylonitrile copolymer and water at a temperature above the boiling point of water at atmospheric pressure and at a temperature and pressure sufficient to maintain water and said polymer as a homogeneous fusion melt, said polymer having a number average molecular weight in the range of about 6,000 up to about 14,750, extruding said fusion melt through a spinnerette directly into a steam-pressurized solidification zone maintained under conditions which control the rate of release of water from the nascent extrudate as it emerges from the spinnerette to avoid deformation of said extrudate and stretching said extrudate while in said solidification zone at a total stretch ratio of at least 10.

2. The process of claim 1 wherein said stretching is at a stretch ratio of at least 25.

3. The process of claim 1 wherein the stretched fiber is steam-relaxed under conditions which provide shrinkage thereof to the extent of about 15 to 40%.

* * * * *